United States Patent [19]

Obkircher

[11] Patent Number: 4,681,599

[45] Date of Patent: Jul. 21, 1987

[54] GASSIFICATION OF CARBON CONTAINING WASTE, REFUSE OR THE LIKE

[75] Inventor: Bernt Obkircher, Aufham, Fed. Rep. of Germany

[73] Assignee: Dornier System GmbH, Friedrichshafen, Fed. Rep. of Germany

[21] Appl. No.: 776,214

[22] Filed: Sep. 16, 1985

[30] Foreign Application Priority Data

Sep. 15, 1985 [DE] Fed. Rep. of Germany ..... 3434004

[51] Int. Cl.[4] ..... C10J 3/48; C10J 3/78

[52] U.S. Cl. ..... 48/92; 48/111; 266/160; 266/205

[58] Field of Search ..... 48/92, 197 R, 210, 111; 202/219; 266/160, 205, 224

[56] References Cited

U.S. PATENT DOCUMENTS 2,612,444 9/1952 Pummel ..... 48/92
3,252,773 5/1966 Solomon et al. ..... 48/202
4,187,672 2/1980 Rasor ..... 48/92
4,362,554 12/1982 Santen ..... 48/210

FOREIGN PATENT DOCUMENTS 2813207 10/1979 Fed. Rep. of Germany ..... 48/92
2095282 9/1982 United Kingdom ..... 48/197 R

*Primary Examiner*—Peter Kratz
*Attorney, Agent, or Firm*—Ralf H. Siegemund

[57] ABSTRACT

Waste or refuse is fed to a first reaction chamber communicating with a second one through openings in the lower portion of a partition between the chambers and hot metal or the like is fed into at least one of the two chambers; gas is extracted from the second chamber and the pressure conditions are such that different liquid levels obtain in the two chambers causing reaction gas to bubble through the openings and the liquid in the second chamber. The principle product gases extracted are hydrogen, carbonoxide and inert gases. Lime is preferably added to the waste to be processed.

15 Claims, 2 Drawing Figures

GASSIFICATION OF CARBON CONTAINING WASTE, REFUSE OR THE LIKE

BACKGROUND OF THE INVENTION

The present invention relates to gassification of carbon containing waste and refuse particularly refuse that includes organic compounds, and more particularly the invention relates to the gassification of refuse wherein a very hot liquid as well as an oxidation medium is brought into contact with the refuse.

It is generally known that, strictly from a stand point of volume and quantities involved, commercial and household refuse garbage etc., constitutes an ever increasing problem particularly if the common practices continues to first deposit the material in an particular location. In the past, therefore, techniques have been developed and used to some extent to burn the garbage or to pyrolyze it. Here, one has to consider the side effect that the thermal energy developed by either form of combustion could be used some form or another. For example, in case of burning of refuse, one can consider a heating value from about 2 to 2.5 kilowatt hours per kilogram. However, it is also well known that in the case of combustion and burning of refuse highly aggressive gases are produced, for example, hydrochloric acid; HF, SO2 and NOX. These gases as captured in the combustion products which constitute exhaust fumes and smoke and have to be removed therefrom, which is an expensive procedure and requires a considerable amount of energy. In many cases such a removal proved to be practically impossible, at least not to the desired degrees considering ecological requirements.

In some cases, refuse is processed by low temperature carbonization under utilization of heat supplied thereto, but under exclusion of air. The problem of contamination of the carbonization gases still remains. Moreover in these cases, certain desired gases such as CH4, H2 and CO are produced but in addition contaminants such as H2S, HCl, HF, tar, oil, phenoles and undesirable hydrocarbons are produced. These contaminating components therefor have to be removed which again is extensive and expensive, usually involving an extensive chemical procedure whereby particularly it is necessary to separate the desirable from the undesirable by-products of the carbonization process.

Aside from the problem of generally disposing refuse, certain special refuse to be disposed poses special problems. For example, certain organic compounds and materials are part of garbage and industrial waste, such as polychlorinated biphenyl (PCB's) hexlal-chlorocyclohexane, (HCH), and dioxine. All these poisionous substances can be neutralized or destroyed only with great difficulties.

A method is known for the gassification of household refuse and is disclosed in German printed Patent Application 3,212,534. Accordingly, the refuse is introduced into a hot iron baph having a temperature between 1130 and 1600 degrees centrigrade, and an oxidation medium is also added. In this method than the refuse is granulized i.e. chopped into particles of at least 50 millimeter size and added to the molten iron, underneath the surface of the bath. The chopping of refuse is again a energy extensive process and in case of certain poisonous refuse the procedure is quite dangerous. Also, introducing the refuse from underneath the surface of molten iron is a ratherh extensive and expensive procedure. Moreover, it is not certain that all of the refuse particles assume the temperature of the molten metal which however is essential in some cases.

DESCRIPTION OF THE INVENTION

It is an object of the present invention to provide a new and improved method and equipment for disposing carbon containing refuse, waste or the live including waste that contains organic compounds, to provide this method and equipment in an economic fashion; and wherein the method is with certainty effective while the end products are not dangerous in any conceivable manner.

It is a particular object of the present invention to provide a new and improved method for gassification of carbon containing waste products under utilization of past procedure wherein the refuse is introduced into a hot liquid bath together with an oxidation medium.

In accordance with the preferred embodiment of the present invention the objects and here, the particular object of the invention are obtained in that two gassification chambers are separated by a partition with an opening in a lower portion which gas chambers will receive the hot liquid and an oxidation medium; the refuse is introduced into the first one of the chambers while the end products together with slag are extracted from the second gas chamber.

Thus, the principle of refuse gassification at a high temperature with the addition of an oxidation medium, preferably air or oxygen, is retained but carried out in a by biparted reactor. The extreme high temperatures i.e. well in excess of 1,000 degrees centigrade is obtained in a reactor using a liquidous metal such as iron, and the refuse is fed into such a reactor. Owing to this high temperature hydrocarbons, i.e. CH compounds and other organic compounds will decompose with certainty, also the hydrogen will escape in the gaseous state while the carbon goes into solution in the liquid metal. This carbon is then oxidized, at least partially oxidized, to produce CO by blowing an oxidation medium into the reactor and the carbonoxide thus procluded will be removed from the still liquidous metal, just as is known in principle during steel manufacturer under utilization of pig iron. The combustible components of the refuse are therefor basically converted into H2 and CO and increase the pressure in the first one of the two reaction chambers. The oxidation process resulting in CO is an exo thermal process and therefor makes sure that the liquidous metal maintains its temperature, provided the reactor is sufficiently thermally insulated. Moreover, the metal will not be consumed in the course of time; in fact it serves only as a heat transfer medium and as a solvent for the carbon. In cases there may be an inbalance in that the refuse and waste does not contain a sufficient amount of carbon for developing enough heat so as to maintain the temperature of the molten metal. In this case, it may be advisable to add carbon to the refuse or to preheat the refuse.

The formation of gas causes the level of the hot liquid in the first gas chamber to be lowered while the liquid level in the second reaction chamber rises. This will continue until the gas level in the first chamber reaches the upper edge of the openings in the partitioning between the two reactor chambers. Thereupon the gas will flow through the openings and into the second chamber carrying along slag or permitting even a flow through larger openings if the level in the first chamber drops further. In either gas, the gas will bubble through the liquid in the second chamber to reach the space filled with gas above the liquid in the second chamber from which it can be withdrawn. These inventive features make sure that all of the gases developed in the reactor are retained therein for not less than a minimum period of time i.e. inside the molten metal, by operation of the bubbling-through process. The gas dynamic production of the hdifference in liquid level in the two chambers is critical for this operation. Therefore, the gas bubbles have assumed the temperature of the metal, whereby preferably at the time when the gas leaves the second chamber, at the time when the gas leaves the second chamber, depending of course on the chosen temperature and the propagation time, with certainty no more hydrocarbon and included in the gas, i.e. the gas is free from any residual of the refuse.

As stated, the preferred liquidous metal to be used is rion and the reactor temperature will be within the range from 1350 to 1,400 degrees centigraded. Certain special organic waste products, particularly ultra poisonous products such a dioxine, PCB, HCH, materials such as Tabun, Somam, Lost etc., must be completely decomposed and with certainty before any dischange and in that case, it may be advisable to use a metal which has still a higher melting point than iron such as chromimum. Also, metal alloys on in metaloxides may have to be used in order to attain still higher temperature for the reaction process.

Uncombustible, slag-forming waste products generally will float in liquidous form on top of the liquidous metal. Above that slag layer will accumulate the reducing gases such H2 and CO possible also H2O. Contaminating products such as sulfur, chlorine, and flulorine compounds that were contained in the refuse will usually be included in the gaseous state and in the form of H2S, HCl, HF etc. In a prefered form of carrying out the invention and in an advantageous manner lime is added to this slag there being a suitable container and feed facilities. The aforementioned gases will then become instable at the high temperature owing to the presence of basic slag so that the contaminants are in fact included in the slag in a liquidous state as CaS, CaCe2, Ca F2, etc.

The slag will be extracted from the reactor continuously and when still in the liquid state and subsequently cooled by means of water. The calcium compounds leaving the slag extraction gate of the system are completely water-insoluble and neutral as far as the ecology and environment is concern and can therefor deposited as a solid waste without posing any problems of any contamination. The product gases leaving the system contain any contaminant such as HCl, HF, H2S etc. only in very small quantities i.e. only a few parts per million.

The oxidation medium may be added either directly to the hot liquid or blown into the first reaction chamber and right into the liquid thereof. The inventive method can be carried out in steps or on a continuous basis. In the latter case, it is an advantage to provide a pressure lock and gate in the first gas chamber so that in case the chamber opens one does not obtain a loss in pressure inside the reaction chamber. This lock opening should be sufficiently large so that entire barrels with a poisonous content can be added, without requiring any refuse chopping. The process temperature as stated can be maintained for example, by adding carbon such as coal dust to the refuse, if it is expected that the carbon content in the waste is not sufficient for developing, through an extrothermic process, the requisite thermal energy that compensates heat lost into the environment. In addition or in the alternatively, certain process gases may be returned and used for combustion. The thermal energy in the product gas can be used in a recuperative process to preheat the refuse. Alternatively water vapor or an inert gas can be used if it is desired to lower the temperature. These gases can also be used for cooling the injection nozzles for the oxidation medium.

The reactor, at least as far as its first reaction chamber is concerned, should be pressure-proof and, a stated it should have a pressure lock and gate in its upper portion for adding the waste and/or the slag forming agent such as lime. The second gas chamber is provided with one or more extractions devices for the gas as well as for the slag. The level of the respective opened extraction gate of the second gas and reaction chamber depends on the liquid level therein.

The reactors use for the gassification process is preferably thermally insulated. For maintaining the reaction temperature to the adding of carbon was mentioned above; instead one man preheat the refuse or the lime using the heat content of the part of gases that are extracted. For start up, one may need an electrical heater for preheating the refuse or the lime. The electrical heating may also serve as supplemental heating in case certain process conditions require additional heating.

In the preferred form of practicing the invention, the two gas chamber are concentrically arranged with respect to each other, e.g. the first gas and reaction chamber is enveloped by the second gas and reaction chamber. One can readily see that in this case, the second gas chamber thermally isolates the first chamber from the environment, because the first chamber has practically no outside surface through which heat can escape.

The cross-section of the openings in the partition between the two gas chambers should increase in down direction so that the gas flowing from one chamber to the other finds in excessively proportioned and increasing cross-section whenever the liquid level in the first chamber is very low. The more the liquid level drops in that chamber from which the gas flows, the more gas will bubble into the second chamber. The same effect can be obtained through larger openings or through an increase in the number of openings in the lower part. Also one can use openings having a geometry in which the cross-section is larger in the lower part than more above for example, one can use triangular openings. The increase in the flow cross-section with increased depth also attenuates any oscillations that may otherwise be set up in and between the two liquid columns. The arrangement of openings in the lower portion of the partition generally will thus control automatically the amount of gas that is transferred. The size of the openings avoids on the other hand, any direct passage of refuse parts which have not yet reacted.

The level height difference of the liquid columns in the two chamber is sufficient to make sure that the product gas resides for sufficiently long periods of time within hot liquid and thus will with certainty assume the temperature of the liquid. Small openings permit only small gas bubbles to pass when-ever the liquid level is low and owing to their small size the bubbles will with certainty assume the temperature of the liquid in the second chamber. Smaller openings may for example, be realized through porous ceramic bricks or other porous, ceramic elements with a particular pore size such as 1 millimeter or smaller. Larger openings in the lower range of the chamber and becoming effective when the liquid level is low permits an easier transfer of liquid into the second gas chamber, this in effect depressurizes the first chamber to some extent and the liquid level therin will rise again.

In summary, one can say the invented method and equipment exhibits the following advantages:

The method permits the extractions of carbon containing waste including special waste without posing any significant problem as the extraction is carried out with certainty, this includes particularly the extraction of waste from organic chemistry including for example, difficult-to-process waste products such as chlorinated hydrocarbon.

Another advantage is the fact that waste of any kind does not have to be pretreated i.e. chopped, cut or the like prior to the gassification process. The volume of the final waste that has to be deposited somewhere is drastically reduced quite comparable to a combustion or pyrolysis process.

The latent heat content of the refuse is used to the extent necessary for automatically maintaining the temperature of the metal.

Coal can be added if the carbon content of the refuse is insufficient. If on the other hand sufficient combustible gas develops, it can be used to preheat the refuse and/or slag forming material, which in turn will favorably reflect when the temperature balance in the reaction chamber.

The principle advantage of the invention is that the contaminantes in the refuse are decomposed and converted into completely neutral i.e. nonpoisonous, noncontaminating substances and compounds which will not interfere with the environment and ecology.

In view of the simplicity of the method, it is expected that the economy offers considerable advantages over conventional combustion, burning or pyrolysis of refuse or waste.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Proceeding now to the detailed description of the drawings, FIG. 1 illustrates a storage bin or vessel for refuse and the arrow 1a indicates the replenishment of this storage facility with refuse being an intermittent or a continuing replenishment. This container 1 is connected by a gate and lock 2 with a thermally insulated reactor 3. A liquid 4 is contained in that reactor whereby particularly a suitable liquid metal is used. As stated, preferably iron is used but a higher melting material such as chromium or a metaloxide may be used when the decomposition requires a higher temperature. An oxidation medium 5 is injected and blown into the liquid inside reactor 3, e.g. from the bottom and under utilization of injection nozzles 6. The reactor 3 is partitioned into two chambers establishing basically two gas and reaction chambers 7 and 8 being separated by a partitioning 9 having openings 9*a* in the lower portion.

Figure 2:
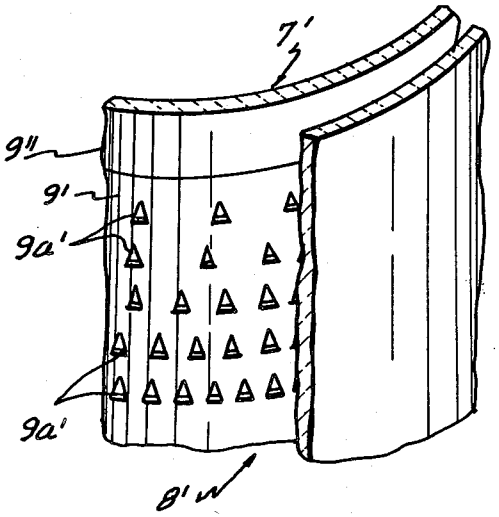
FIG. 2 illustrates a portion of a modification of the inventive device.
Figure 1:
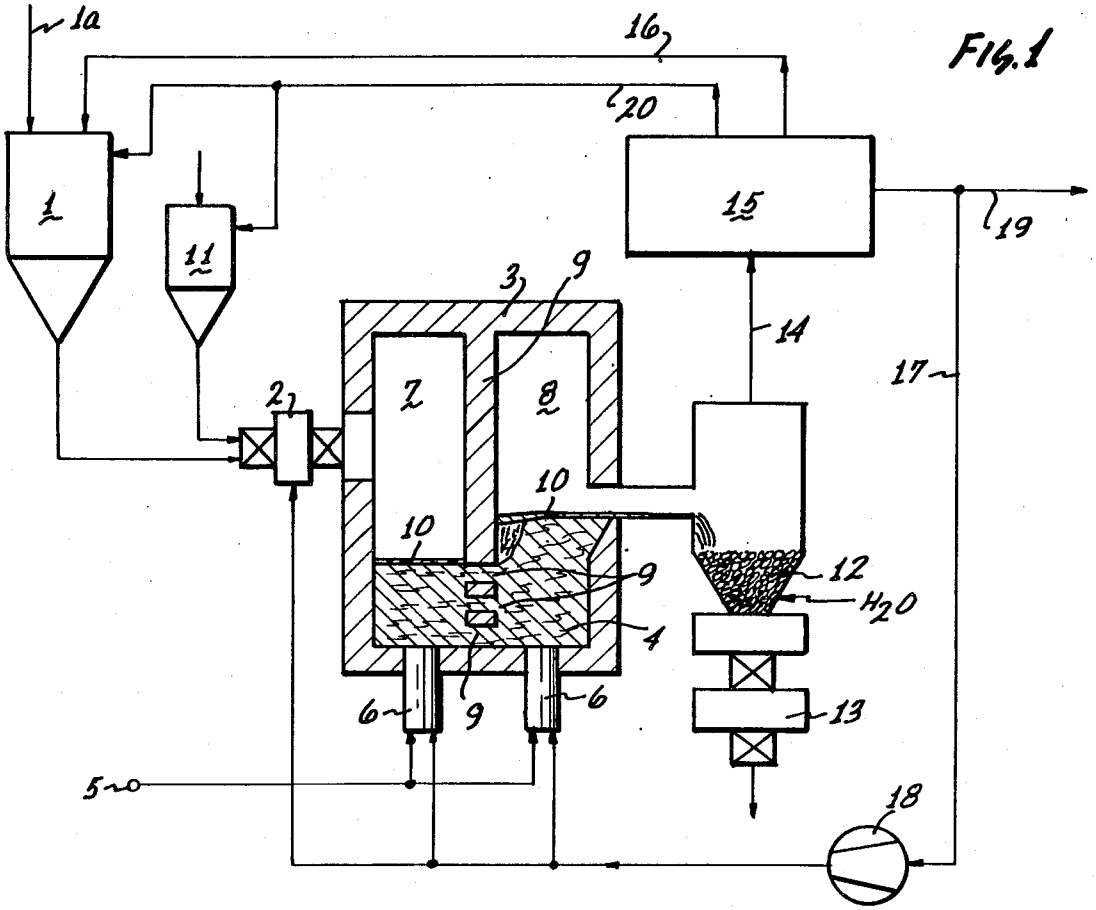
FIG. 1 shows somewhat schematically a diagram and flow chart for practicing the method in accordance with the preferred embodiment of the present invention for practicing the best made thereof.

Since slag 10 is to be expected to float on the surface of the liquid 4, lime is added from a storage bin 11 also through the block and gate 2. In order extract slag from the reaction chamber 8, a slag cooling device 12 is provided as well as slag extraction lock and gate 13. In order to extract product gas from the reactor and here particularly from the chamber 8, a gas extraction device 14 is provided; generally a known extractor 15 is used in a heat exchange version to use the heat content of that gas in some form or another, and to dedust the gas before discharge. Preferably, dust is fed via a return path 16 into the storage 31 to serve and to be treated as waste to be processed by the equipment.

A portion of the product gas is extracted from the deduster 15 via a conduit 17 under the utilization for example, of a pump 18 which feeds the gas to the nozzle 6 and to the lock and gate 2 for cooling same. The remaining portion of the product gas having been cleaned is extracted via a line 19 for further utilization such as extraction and separation of usefull gasses; for combustion or the like.

In accordance with the inventive process therefor waste is treated as follows: garbage, refuse, waste, etc., from the storage bin 1 or even entire barrels loaded with waste products are passed through the locking gate 2 in the entrance of the first gas chamber 7 and are dumped into the liquid 4 therein. On contact the combustible component of the waste will decompose into hydrogen and carbon. Uncombustible slag forming components will float as slag 10 on the top of the liquid 4. Oxidation material such as air or pure oxygen is blown by means of nozzle 6 into both chambers 7 and 8 and here particularly into the bottom of the liquid metal therein. The carbon that form on contact with the liquid, particularly in chamber 7, goes into solution in the liquid 4 but will at least partially be oxidized into CO.

The formation of CO causes the pressure in the chamber 7 to increase so that a portion of the liquid 4 is forced through the opening 9*a* into the gas chamber 8. The gas pressure in chamber 8 is determined essentially by the gas extraction. This then accounts for the different levels in liquid in the two chambers because the gas pressure in chamber 7 is and will remain higher than in 8. Generally, it can expected that, as the pressure increases in chamber 7, the liquid level in chamber 7 will drop below the upper edge of the highest opening 9*a*. Accordingly, gas i.e. product gas as well as slag flows into the chamber 8 and, as indicated somewhat schematically, gas bubbles through the upper portion of the liquid 4 in chamber 8 and of course slags floats up to surface level in chamber 8.

The aspect just discussed is very important because the bubble formation makes sure that the gas that has developed primarily in chamber 7 will with certainty assume the temperature of the liquid, and this phenomemon occurs in a heat exchange process as the gas bubbles through the liquid. Slag and product gas are then extracted from the chamber 8 at a suitable level and, as stated that slag is preferably cooled with water and leaves the system through the gate and lock 13.

The product gas is extracted via 14 and passes through the heat exchange and de-dusting stage 15 for utilization of the heat content to thereby be cooled, and for dedusting. The dust is fed back into the system as refuse or waste (conduit 16). Some of the gas is extracted via line 17 and is compressed is used for cooling nozzles 6 for the oxidizing medium 5 and for pressurizing the lock and gate 2 the entrance of the reactor. The remaining part of the cleaned and cooled gas is extracted from the system while aisle line 19 for purposes of electricity generation and/or combustion and other heating processing. The waste heat extracted from the raw gas by the device 15 is preferably used for heating or better preheating the refuse is well as a lime. Line 20 indicates schematically the heat transfer process.

FIG. 2 illustrates by a way of example the preferred construction of the two process chambers; in this case 7' and 8' prime are arranged as concentric chambers wherein the second chamber 18' envelopes the primary reaction chamber 7'. Also, it can be seen in this drawing that openings and perforation **9*a* in the partition 9' are of triangular configuration and increase in number in down direction, so that with sinking liquid level in chamber 7 more gas in disproportional quantities will flow into chamber 8**.

The invention is not limited to the embodiments described above; but all changes and modifications thereof, not constituting departures from the spirit and scope of the invention, are intended to be included.

I claim:

1. An apparatus for the gassification of carbon containing refuse, or waste or the like, comprising:

reactor means including a top and bottom, and a first reaction chamber, and a second reaction chamber located next to each other, there being a vertical partition means between said reaction chambers extending from the reactor top down to the reactor bottom, said partition having in its lower part a plurality of relatively small openings which increase in total cross-sectional area in a downward direction the chambers containing a liquid bath having a temperature in excess of 1000 degrees centigrade;

means for introducing waste etc, into the upper portion of the first chamber for dropping into the liquid bath;

means for introducing from a lower level of at least one of said chambers an oxidizing medium, the liquid bath level in the second chamber is and remains above said openings, said reactor constructed so that developed pressure in the first chamber forces liquid in the first chamber into a lower level than the level in said second chamber so as to obtain a liquid level difference in the two chambers; and means for extracting slag and gas from the second chamber.

2. Apparatus as in claim 1 wherein said means for introducing an oxidizing medium includes injection nozzles.

3. Apparatus as in claim 1 including a pressure lock and gate for the upper portion of the first chamber for the introduction of refuse.

4. Apparatus as in claim 1 and including in addition means for introducing a slag forming agent into the first chamber, and said means for extracting including means for extracting slag in a liquidous state.

5. Apparatus as in claim 1 wherein said liquid is one or more of the following metals selected from the group consisting of iron, cobalt, nickel, chromium and manganese.

6. Apparatus as in claim 1 wherein said hot liquid is a metal oxide.

7. Apparatus as claim 6 wherein said metal oxide is copper oxide.

8. Apparatus as in claim 1 including means for returning some of the gas into at least one of the reaction chambers for purposes of temperature control.

9. Apparatus as in claim 1 including means for extraction a portion of the heat content of the extracted gases to obtain preheating of the refuse.

10. Apparatus as in claim 1 wherein at least one of the chambers is constructed in a pressure proof configuration.

11. Apparatus as in claim 1 wherein said chambers are concentrically arranged, the second one in enveloping the first one.

12. Apparatus as in claim 1 wherein at least some of said openings are established by a porous part of the partition.

13. Apparatus as in claim 1 wherein the number of apertures increases in down direction.

14. Apparatus as in claim 1 wherein the size of the apertures increases in down direction.

15. Apparatus as in claim 1 wherein both the number and the size of the apertures increase in down direction.

* * * * *